United States Patent [19]

Rautio

[11] Patent Number: 4,572,256

[45] Date of Patent: Feb. 25, 1986

[54] SAW MACHINE

[76] Inventor: Kauko Rautio, Kolmihaarantie, 52700 Mäntyharju, Finland

[21] Appl. No.: 551,172

[22] Filed: Nov. 14, 1983

[51] Int. Cl.[4] ..... B27B 7/04; B27B 25/02

[52] U.S. Cl. ..... 144/39; 144/378; 83/102.1; 83/441.1; 83/446

[58] Field of Search ..... 83/102.1, 441.1, 446, 83/449; 144/39, 41, 378

[56] References Cited

U.S. PATENT DOCUMENTS

| | | | |
|---|---|---|---|
| 259,661 | 6/1882 | Bowker | 83/102.1 |
| 1,263,443 | 4/1918 | Lien | 83/441.1 |
| 4,127,044 | 11/1978 | Kenyon | 83/446 |
| 4,144,782 | 3/1979 | Lindstrom | 83/102.1 |
| 4,416,312 | 11/1983 | Östberg | 83/102.1 X |
| 4,440,203 | 4/1984 | Ostberg | 144/39 |

*Primary Examiner*—Donald R. Schran

*Attorney, Agent, or Firm*—Martin Smolowitz

[57] ABSTRACT

A saw machine with one or more saw blades for ripping a log, after which are provided one or more parting knives. The problem occurring in saw machines of prior art is that the spacing of the fixed guiding points working the log, as viewed in the direction in which the log is being sawn, becomes so large that curve-sawing is no longer possible. The saw machine of the invention is characterized in that both the saw blades (7) and the parting knives (8) are located in a separate sawing unit (6) articulatedly attached to the frame (9) of the saw machine and thereby following the crookedness of the log (11).

8 Claims, 2 Drawing Figures

SAW MACHINE

Figure 1:
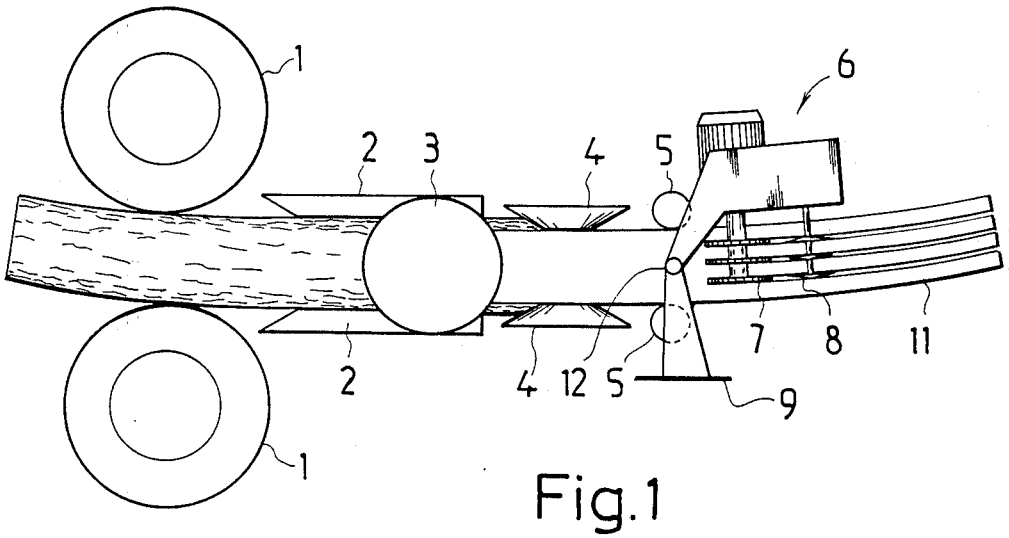

The present invention concerns a saw machine with one or several saw blades ripping up logs and one or several parting knives disposed after the saw blades.

Such saw machine mountings are known in the art in which the guides, saw blades and parting knives are fixedly mounted in the saw machine. The problem in such designs is that the spacing of the fixed guiding points working the timber, as viewed in the direction in which the log is sawed, becomes so large that curve-sawing is no longer possible. Therefore the saw blade or blades fail to follow the crookedness of the log and they will saw the log on the line on which they have been fixedly mounted. This reduces substantially the wood utilization ratio from the log.

The object of the invention is to eliminate the drawback mentioned in the foregoing and to provide a new type of saw machine. The saw machine of the invention is characterized in that both the saw blades and the parting knives are located in a separate sawing unit articulatedly connected to the saw machine frame and thereby following the crookedness of the log. The articulated attachment of the sawing unit enables curve-sawing to be carried out even when processing large-diameter logs, because due to the articulated attachment of the sawing unit the spacing of the fixed guiding points and the saw blades in the direction of sawing is short enough and the saw blades and the parting knife can better follow the crookedness of the log during the sawing process.

The invention is described in the following by the aid of an example by referring to the drawing attached, wherein:

FIG. 1 presents a log between the blades and guides of the saw machine, in elevational view.

Figure 2:
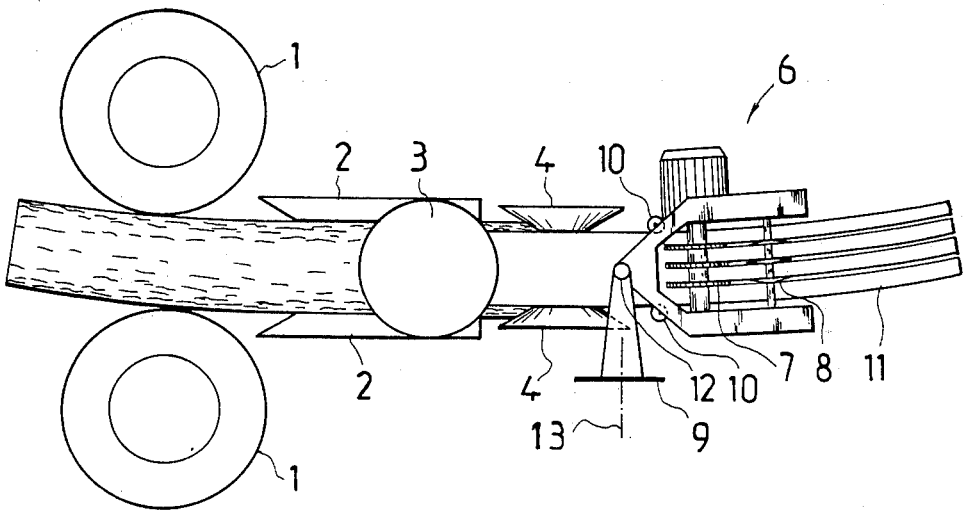

FIG. 2 shows substantially the same as FIG. 1, but with a sawing unit according to another embodiment of the invention.

The saw machine comprises, listed in as shown by FIG. 1 the feeding direction, elastically mounted pull wheels 1, a self-centering set of guide rails 2, hewing cutters 3,4 rotatable about a horizontal axis and a vertical axis respectively, dual, guide rollers 5 rotatably attached to support frame 9, and a sawing unit 6. The multiple parallel saw blades 7 are circular and rotatable on a shaft by a drive motor, and the parting knives 8 are located in the sawing unit 6, which is attached to the frame 9 of the saw machine in an articulated manner so that the parting knives 8 guide the sawing unit to thereby following the crookedness of the log.

In the embodiment in FIG. 2, the sawing unit comprises guide rollers 10 located in front of the saw blades 7 an rotatably attached to the saw unit 6. These guide rollers 10 contact the log and guide the sawing unit 6 in accordance with the crookedness of the log or timber 11. The sawing unit 6 has been articulatedly attached to the frame 9 of the saw machine to swivel about a horizontal axis 12, and it may in addition be mountd to be turnable about a vertical axis 13 indicated with a dash-and-dot line in FIG. 2.

By virtue of the mobility which the articular arrangement affords to the sawing unit 6, curve-sawing is now successfully managed also with large-diameter circular saw blades 7.

It is obvious to a person skilled in the art that diverse embodiments of the invention may vary within the scope of the claims presented below. For instance, the number of saw blades 7 and of parting knives 8 may vary from one to several. Depending on the straightness or crookedness of the log being sawed, the saw blade 7 and the parting knife 8 may during the sawing process be in alignment with the lines of the hewing cutters 3,4 hewing the sides of the log, as in the example, or they may lie on a different line, that is, the parting knife 8 has been pivotally mounted with reference to the saw blade 7.

I claim:

1. A saw machine for ripping a log, comprising:

a sawing unit articulatedly attached to a frame member of the saw machine;

multiple circular parallel saw blades located rotatably in said sawing unit for ripping the log;

a parting knife located in said sawing unit after each said saw blade;

means for feeding the log through said sawing unit;

and dual guide rollers located ahead of the sawing unit, wherein the multiple saw blades and the parting knives located in said separate sawing unit articulated to the frame member are guided by the parting knives to follow the crookedness of the log being ripped.

2. A saw machine according to claim 1, wherein dual elastically-mounted pull wheels are provided upstream of said sawing unit for feeding the log through said sawing unit.

3. A saw machine according the claim 2, wherein a set of self-centering guide rails is provided located between said sawing unit and said pull wheels for centering the log.

4. A saw machine according to claim 2, wherein dual hewing cutters rotatable about a horizontal axis are provided ahead of said sawing unit.

5. A saw machine according to claim 2, wherein dual hewing cutters rotatable about a vertical axis are provided ahead of said sawing unit for hewing the outer surface of the log, and the dual guide rollers are provided between said vertical axis dual hewing cutter and said sawing unit for guiding said sawing unit.

6. A saw machine according to claim 1, wherein said sawing unit is articulatedly attached to said frame so as to swivel about a horizontal axis, said horizontal axis being in turn mounted to said frame so as to be turnable about a vertical axis.

7. A saw machine for ripping logs, comprising:

(a) a sawing unit articulatedly attached to a frame member of the saw machine;

(b) multiple circular parallel saw blade located rotatably in said sawing unit for ripping a log;

(c) a parting knife located in said sawing unit after each said saw blade;

(d) dual elastically-mounted pull wheels provided upstream of said sawing unit for feeding the log through the sawing unit;

(e) dual hewing cutters rotatable about a vertical axis provided ahead of said sawing unit for hewing the outer surface of the log; and (f) dual guide rolls provided between said hewing cutters and said sawing unit for guiding the sawing unit, whereby the rotatable saw blades and the parting knives follow the crookedness of the log being ripped.

8. A saw machine for ripping logs, comprising:

(a) a sawing unit articulatedly attached about a horizontal axis to a frame member of the saw machine, said horizontal axis being in turn mounted to said frame so as to be turnable about a vertical axis;

(b) multiple circular parallel saw blades located rotatably in said sawing unit for ripping a log;

(c) a parting knife located in said sawing unit after each said saw blade;

(d) dual elastically-mounted pull wheels provided upstream of said sawing unit for feeding the log through the sawing unit;

(e) dual hewing cutters rotatable about a vertical axis provided ahead of said sawing unit for hewing the outer surface of the log; and (f) dual guide rolls provided between said hewing cutters and said sawing unit for guiding the sawing unit, whereby the circular saw blades and the parting knives follow the crookedness of the log being ripped.

* * * * *